US009359858B2

(12) United States Patent
Themig

(10) Patent No.: US 9,359,858 B2
(45) Date of Patent: Jun. 7, 2016

(54) WELLBORE FLUID TREATMENT PROCESS AND INSTALLATION

(71) Applicant: PACKERS PLUS ENERGY SERVICES INC., Calgary (CA)

(72) Inventor: Daniel Jon Themig, Calgary (CA)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 330 days.

(21) Appl. No.: 13/960,592

(22) Filed: Aug. 6, 2013

(65) Prior Publication Data

US 2013/0319676 A1 Dec. 5, 2013

Related U.S. Application Data

(63) Continuation of application No. 12/995,649, filed as application No. PCT/CA2009/000817 on Jun. 8, 2009, now Pat. No. 8,511,394.

(60) Provisional application No. 61/059,429, filed on Jun. 6, 2008.

(51) Int. Cl.

| | |
|---|---|
| ***E21B 23/06*** | (2006.01) |
| ***E21B 33/124*** | (2006.01) |
| ***E21B 43/12*** | (2006.01) |

(52) U.S. Cl.

CPC ..... *E21B 33/124* (2013.01); *E21B 43/12* (2013.01)

(58) Field of Classification Search

CPC ..... E21B 23/06; E21B 33/122; E21B 33/124
USPC ..... 166/73, 123, 125, 181, 182, 332.4, 318, 166/191

See application file for complete search history.

(56) References Cited

U.S. PATENT DOCUMENTS

| | | | | |
|---|---|---|---|---|
| 3,062,291 | A | 11/1962 | Brown | |
| 3,381,749 | A | 5/1968 | Chenoweth | |
| 4,519,456 | A * | 5/1985 | Cochran | E21B 37/08 166/147 |
| 5,291,947 | A | 3/1994 | Stracke | |
| 5,335,732 | A | 8/1994 | McIntyre | |
| 2,606,616 | A | 8/1995 | Otis | |
| 5,513,703 | A * | 5/1996 | Mills | E21B 34/14 166/316 |
| 5,921,318 | A * | 7/1999 | Ross | E21B 34/124 166/316 |

(Continued)

FOREIGN PATENT DOCUMENTS

| | | |
|---|---|---|
| CA | 2472824 C | 12/2005 |

*Primary Examiner* — Kenneth L Thompson
(74) *Attorney, Agent, or Firm* — Bennett Jones LLP

(57) ABSTRACT

A method for isolating a perforated interval of a well, the well including a casing liner having a wall with a plurality of perforations therethrough forming the perforated interval, the method comprising: providing a tool including a tubular body including an inner diameter and an outer surface, a first open end and a second open end, the first and second open ends providing access to the inner diameter; and a sealing element to isolate a mid region of the outer surface from the first open end and the second open end; positioning the tool in the well with the tubular first open end adjacent and above an uppermost perforation of the perforated interval and the second open end adjacent and below a lowermost perforation of the perforated interval; and installing the tool in the well with the sealing element sealing between the tubular body and the casing wall above the uppermost perforation of the perforated interval and below the lowermost perforation of the perforated interval to isolate fluid flow between the perforations and the inner diameter.

27 Claims, 5 Drawing Sheets

(56) References Cited

U.S. PATENT DOCUMENTS 6,460,619 B1 * 10/2002 Braithwaite ..... E21B 33/124 166/191
6,695,057 B2 2/2004 Ingram et al.
6,782,948 B2 8/2004 Echols et al.
6,923,261 B2 8/2005 Metcalfe et al.
6,951,331 B2 10/2005 Haughom et al.
7,051,812 B2 5/2006 McKee et al.
7,128,157 B2 10/2006 Hoffman et al.
7,134,505 B2 * 11/2006 Fehr ..... E21B 33/124 166/191
7,726,395 B2 6/2010 McHardy et al.
2008/0066912 A1 3/2008 Freyer et al.

* cited by examiner

WELLBORE FLUID TREATMENT PROCESS AND INSTALLATION

RELATED APPLICATIONS

This application claims convention priority to U.S. provisional application 61/059,429, filed Jun. 6, 2008.

FIELD

The invention relates to wellbore tools, installations and methods.

BACKGROUND

Wellbore fluid treatment in cased wells may be complicated if the well includes multiple perforations along the length of the well. The perforations can access different formations within the well and thus simple injection of treatment fluids would access all formations accessed by all perforations. If the well is horizontal, several perforated sections may be required to access formation rock along the horizontal well. If fluid treatment such as acidizing or hydraulic fracturing is required, then a method of isolating sections within the well may be required. If all perforated sections are open and if treatments are desired in only selected perforations (i.e. selected intervals), other procedures must be employed.

If selected intervals are to be treated (fracturing or acidizing for example) with well treating fluids, it may be desirable to control where these fluids are placed, and in what volumes. One method might be to individually perforate and treat intervals. If multiple intervals are to be treated, all steps would be repeated for each treatment.

As such in wells with multiple perforated intervals, isolated fluid treatments may be conducted by running a treatment string into the well such as one disclosed in applicants previous U.S. Pat. Nos. 6,907,936 or 7,108,067. In such a process, ports of the tubing string are positioned adjacent the perforations and packers on the string are positioned to isolate a selected portion of the well about the perforations. Other methods use fluid diversion to place fluids throughout multiple perforated intervals.

Alternately, wellbore treatments may be conducted while perforating. For example, a process may be employed wherein the well is perforated, if any perforations exist therebelow, access to them is plugged as by use of a bridge plug, and the well is then treated. This process maybe repeated for further perforations uphole from the first, by repeating the treatment steps for each operation. This limits efficiencies.

Herein the terms wellbore liner and casing are used interchangeably. Such terms should be considered to include various types of wellbore liners that may include or have formed therein perforations. Such liners may be termed liner, screen, casing, etc.

SUMMARY OF THE INVENTION

According to one aspect of the present invention, there is provided a wellbore treatment tool comprising: a tubular body including an inner diameter and an outer surface, a first open end and a second open end, the first and second open ends providing access to the inner diameter, an installation assembly for installing the tubular body in a casing string; and a sealing element to isolate a mid region of the outer surface from the first open end and the second open end.

In accordance with another broad aspect of the present invention, there is provided a wellbore installation comprising: a wellbore liner including a perforated interval; a tubular member installed over the perforated interval in the inner diameter of the wellbore liner, the tubular member including an open upper end adjacent an upper limit of the perforated interval, an open lower end adjacent a lower limit of the perforated interval; and a sealing element settable to create a seal between the tubular member and the wellbore liner in a position between the open upper end and the perforated interval and between the open lower end and the perforated interval.

In accordance with another aspect of the present invention, there is provided a method for isolating a perforated interval of a well, the well including a casing liner having a wall with a plurality of perforations therethrough forming the perforated interval, the method comprising: providing a tool including a tubular body including an inner diameter and an outer surface, a first open end and a second open end, the first and second open ends providing access to the inner diameter; and a sealing element to isolate a mid region of the outer surface from the first open end and the second open end; positioning the tool in the well with the tubular first open end adjacent and above an uppermost perforation of the perforated interval and the second open end adjacent and below a lowermost perforation of the perforated interval; and installing the tool in the well with the sealing element sealing between the tubular body and the casing wall above the uppermost perforation of the perforated interval and below the lowermost perforation of the perforated interval to isolate fluid flow between the perforations and the inner diameter.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

A wellbore tool, installation and method have been invented for providing a patch over a perforated segment of a well. The tool can act to patch the perforations so that the perforations and the formation accessed through them can be isolated against fluid communication with the wellbore. The tool is secured in the wellbore at a selected location, such as over a perforated interval along the well and can be made to be removable such that the perforations can be returned to a fully opened, uncontrolled position. The tool carries seals along a body and can provide a substantially full seal between the perforations and the inner bore of the well. Alternately, the tool can be ported to provide controlled access to the perforations by opening and closing the port, the seals of the tool controlling against substantially any flow around the tool to the perforations except through the port.

Figure 1:
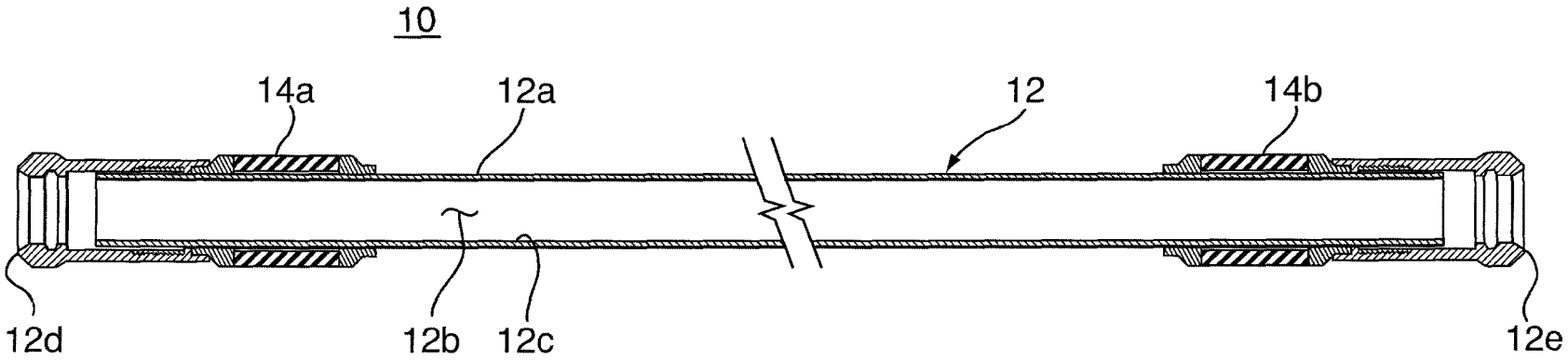
FIG. 1 is an axial sectional view of wellbore tool to allow mechanical isolation of a perforated segment in a well.

Referring to FIG. 1, a tool 10 according to one aspect is shown. The tool includes a tubular body 12 including an outer surface 12*a* and an inner diameter 12*b* defined by an inner wall surface 12*c*. The tubular body is open ended, including a first open end 12*d* and a second open end 12*e*, opposite to the first. The first and second open ends provide access to the inner diameter of the tubular body. In this illustrated embodiment, tubular body 12 presents a solid, fluid tight conduit from end 12*d* to end 12*e*, without any ports providing communication between inner diameter 12*b* and outer surface 12*c* through the wall. In other possible embodiments, tubular body can be ported, as shown in FIG. 2. Of course, as is known for oilfield tools, the tubular body may be formed in parts and connected together in various ways, as by interfitting, threading, forming, welding, etc.

Tool 10 further includes one or more seal elements 14*a*, 14*b* settable to serve a few purposes. First, the seal elements act as an installation assembly to permit installation of the tubular body in the wellbore. In addition, the seal elements act to isolate a mid region of the outer surface from the first open end and the second open end.

Any installation assembly may operate to secure the tubular body of the tool in the wellbore. The installation assembly may be selected to allow the tool to be conveyed downhole by passing through the inner diameter of the wellbore liner, before being installed in a selected location. In one embodiment, for example, the installation assembly may include seal elements as shown or other expansion mechanisms such as one or more of slips, packers, lock dogs, deformable sections, etc. Any expansion mechanism may initially be in a retracted position, with the securing mechanisms held close to the tubular body such that the effective tool diameter is less than the inner diameter of the wellbore. This allows the tool to be conveyed downhole and positioned. Thereafter, the expansion mechanism of the installation assembly may be expanded to enlarge their effective diameter and to effect an installation, when it is desired to do so.

Since the intention of the tool is to act as a patch to control fluid access to the perforated interval so that fluid communication, such as fluid treatment or production, can be limited to specified intervals of the formation, the tool may be selected to restrict and seal against fluids passing behind the tool, between the tubular body's outer surface and the wellbore wall against which the tool is installed. Therefore, for example, sealing elements may seat and seal between the tool's tubular body and the liner. In one embodiment, for example, the tool may carry annular seals, creating an isolated mid region on the outer surface therebetween. The seals may be positioned with consideration as to the length of the perforated intervals in the well being treated. The seals may be those that are set permanently or may be set downhole, as by utilization of expandable packers. Of course, other seals may be used. For example, the tool may be sized to limit the clearance between the tool and the wellbore liner such that a seal is effectively created, but this may complicate run in procedures.

In the illustrated embodiment, for example, there is a first annular seal 14*a* carried on the outer surface, encircling the tubular member adjacent the first open end 12*e* and a second annular seal 14*b* carried on the outer surface, encircling the tubular member adjacent the second open end 12*e*. Sealing elements 14*a*, 14*b* can be settable to form a seal between the tool and the casing wall of the wellbore in which it is installed. Sealing elements 14*a*, 14*b* being positioned at both the top and the bottom of the tubular body, when set, operate to isolate a mid region of outer surface 12*a* from the open ends 12*d*, 12*e*. Of course, that mid region is the region between seals 14*a*, 14*b*.

In one embodiment, the seal may be mechanically compressed and extruded to form the seal between the tool and the casing. The force required to set the sealing element may come from a hydraulically activated setting tool, as will be described in reference to FIGS. 2. In other embodiments, the sealing elements may be compressed by hydrostatic cylinders that are contained in the tool or mechanically set using a running tool to provide forces. In another embodiment, the sealing elements may be extruded using chemical process to cause the element to swell and thereby form a seal. In another embodiment, the sealing elements may be inflated by forcing fluid under pressure beneath the element to cause it to seal against the casing.

A tool according to the present invention may be installed to form a wellbore installation. For example, with reference to FIGS. 2, the wellbore installation may include a wellbore liner 120 including a perforated interval with one or more perforations 122 formed therethrough. A tool 110 may be installed in the inner diameter of the wellbore liner to act as a patch over the perforated interval. The tool may include body 112 including an outer surface 112*a* and an inner bore 112*b* defined by an inner wall surface 112*c*. The tubular body is open ended, including a first open end 112*d* and a second open end 112*e*, opposite to the first. The first and second open ends provide open access from the wellbore inner diameter to inner diameter 112*b* of the tubular body.

Figures 2A, 2B, 2C:
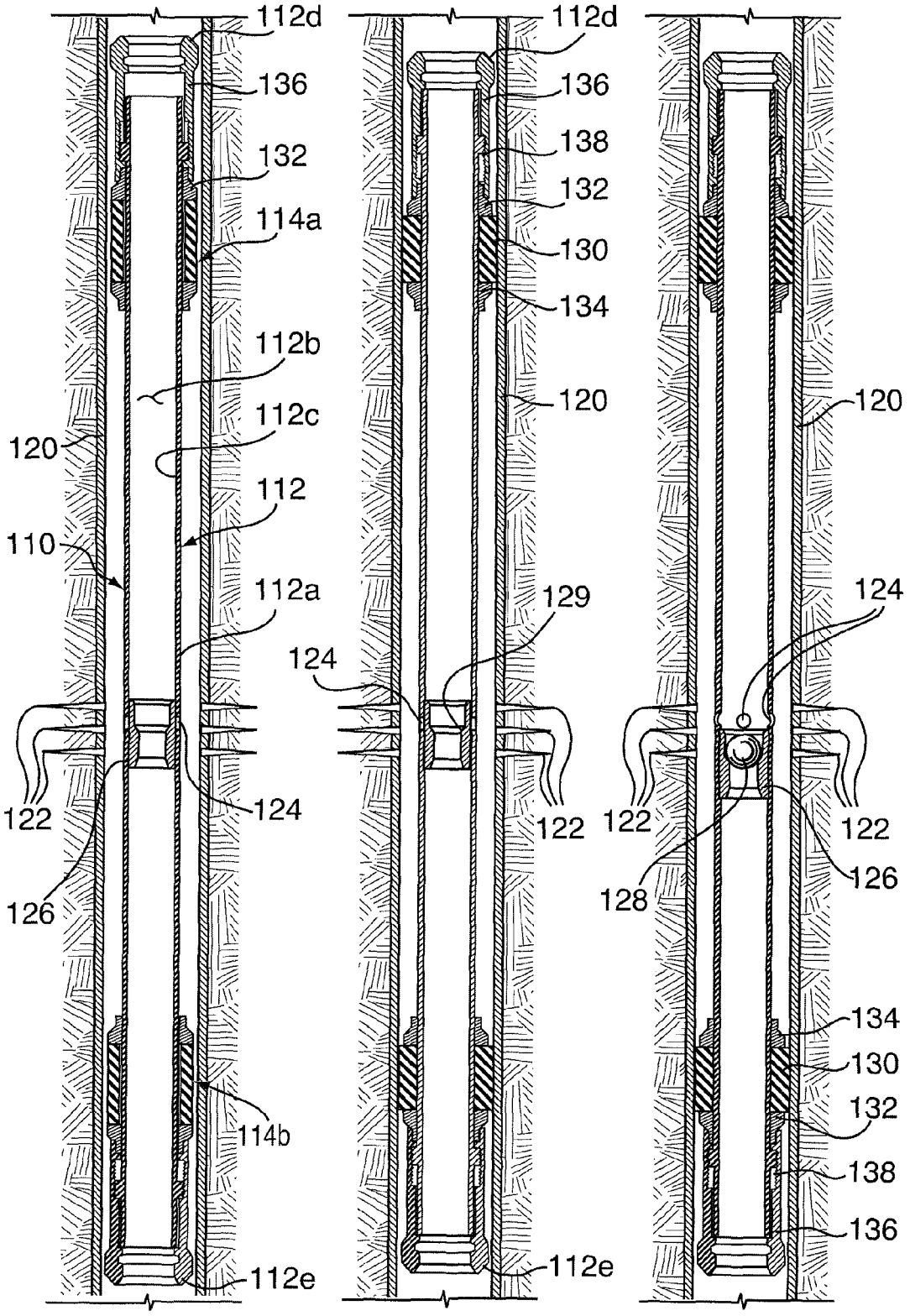
FIGS. 2A, 2B and 2C are sequential views of a tool such as that of FIG. 2 being installed in a wellbore.

The tool further includes a first annular seal 114*a* carried on the outer surface, encircling the tubular member adjacent the first open end 112*e* and a second annular seal 114*b* carried on the outer surface, encircling the tubular member adjacent the second open end 112*e*. Sealing elements 114*a*, 114*b* can be set (as shown in FIGS. 2B and 2C) to form a seal between the tool and the wall of the liner 120 in which it is installed. Sealing elements 114*a*, 114*b* being positioned at both the top and the bottom of the tubular body, when set, operate to isolate a mid region of outer surface 112*a* from the open ends 112*d*, 112*e*. Of course, that mid region is the region between seals 114*a*, 114*b*.

When installed, first annular seal 114*a* is positioned adjacent and above an upper limit of perforations 122 of the perforated interval and second annular seal 114*b* is positioned adjacent and below a lower limit of the perforations of the perforated interval. A perforated interval is generally no more than 8 meters (approx 24 ft.) long and often only about 3 meters (approximately 9 ft.) long. As such, seals 114*a*, 114*b* may generally be separated to form a mid region of approximately 10 meters (approx. 30 ft). In one embodiment, the seals are separated by a distance of 5 to 10 meters (approx 15 to 30 ft). The tubular body can be approximately the same length or slightly longer. For example, the tubular body can measure 5 to 12 meters (15 to 36 ft) and when installed the open upper end of the tubular is adjacent the uppermost perforation of the perforated interval and the lower end of the tubular is adjacent the lowermost perforation of the perforated interval. By adjacent, it is to be understood that the tubular ends are generally within 5 meters of the closest perforation to be covered and possibly within 3.5 meters or possibly no more than 1 meter from the closest perforation to be isolated by the tool.

In this illustrated embodiment, the wall of the tubular body 112 is ported, including one or more ports 124 extending therethrough in the mid region (i.e. along the wall between seals 114*a*, 114*b*) to provide fluid communication between the inner diameter 112*b* and outer surface 112*a*, and thereby from the wellbore inner diameter to the perforated interval, through the port. The ports 124 are closable and openable. When closed, fluid communication is restricted between the inner diameter and the perforated interval and, when open, fluid communication is permitted. Since seals 114*a*, 114*b* substantially prevent fluid from passing from the ends behind the tool to access the perforations, ports 124 can controllably allow fluid communication with the perforations.

The ports are formed to allow for fluid treatment to the perforations and/or production from the perforations. For example, ports 124 can be selected to permit fluid passage from the inner diameter of the tool to its outer surface and/or in a reverse direction. As such, the ports may selectively allow or disallow fluid wellbore treatments therethrough such as stimulation, fracing, etc. and/or the ports may selectively allow or disallow production of fluids from the formation into the wellbore liner.

The tool may include closures for the ports such that the ports may be closed off against fluid flow and the ports may be opened to permit fluid flow therethrough by removal of the closures. The closures may include, for example, a sliding sleeve, burst mechanisms, shearable caps, etc. For example, the ports may be opened by shearing as disclosed in applicant's corresponding U.S. Pat. No. 6,907,936, issued Jun. 21, 2005 or by a sliding sleeve type valve as more fully disclosed in applicant's U.S. Pat. No. 7,134,505, issued Nov. 14, 2006. Alternately or in addition, the ports may be opened all at once, as by use of a hydraulically openable valve as disclosed in applicants corresponding PCT application PCT/CA2009/000599, filed Apr. 29, 2009. Alternately, the ports may be opened in stages, as more fully disclosed in applicant's U.S. Pat. No. 7,134,505, issued Nov. 14, 2006.

In the illustrated embodiment, ports 124 are closed by a sliding sleeve valve 126. In this illustrated embodiment, the sliding sleeve is moveable remotely from its closed port position, substantially as shown, to its position permitting through-port fluid flow, for example, without having to run in a line or string for manipulation thereof. In one embodiment, the sliding sleeve is actuated by a device, such as a ball 128 (as shown) or plug, which can be conveyed by gravity or fluid flow through the tubing string. The device, in this case ball 128, engages against the sleeve and, when pressure is applied through the inner bore 112*b*, as from surface through liner 120 to the tool, ball 128 seats against and creates a pressure differential above and below sleeve 126 which drives the sleeve toward the lower pressure side (downhole of the sleeve).

In the illustrated embodiment, the inner surface of the sleeve, which is open to the inner bore 112*b* of the tool, defines a seat 129 by a diameter constriction in the sleeve onto which a suitably sized ball, when launched from surface, can land and seal thereagainst. When the ball seals against the sleeve seat and pressure is applied or increased from surface, a pressure differential is set up which causes the sliding sleeve on which the ball has landed to slide to a port-open position. When the ports 124 are opened, fluid can flow therethrough. In a formation treatment application, for example, the fluid flows into the annulus between the tool and wellbore liner 120 and seals 114*a*, 114*b* contain the fluid and direct it through perforations 122 into contact with formation.

In the illustrated embodiment of FIG. 2, seals 114*a*, 114*b* operate to both create fluid tight seals and as an installation assembly to secure the tubular body in the liner. In the illustrated embodiment, seals 114*a*, 114*b* are expandable by compression which causes them to extrude outwardly. As shown, for example, seals 114*a*, 114*b* may each include deformable annular elements 130 retained between end rings 132, 134. End ring 134 is fixed on tubular body 112, creating an immovable stop wall. End ring 132 is driven by a setting sleeve 136 that can be driven to drive ring 132 against element 130 to compress and extrude it radially outwardly, as directed by the tubular body and ring 134. Once the element is extruded, the movement between the setting sleeve 136 and tubular body 112 of the tool can be locked in place using a lock system, such as a ratcheting device 138, that will allow movement in one direction, but locks the movement in once the seal is set.

Once the tool is set and in place, it allows mechanical diversion of fluids while the port is closed, but allow fluid to pass through the tool to a lower portion in the well.

Figure 3:
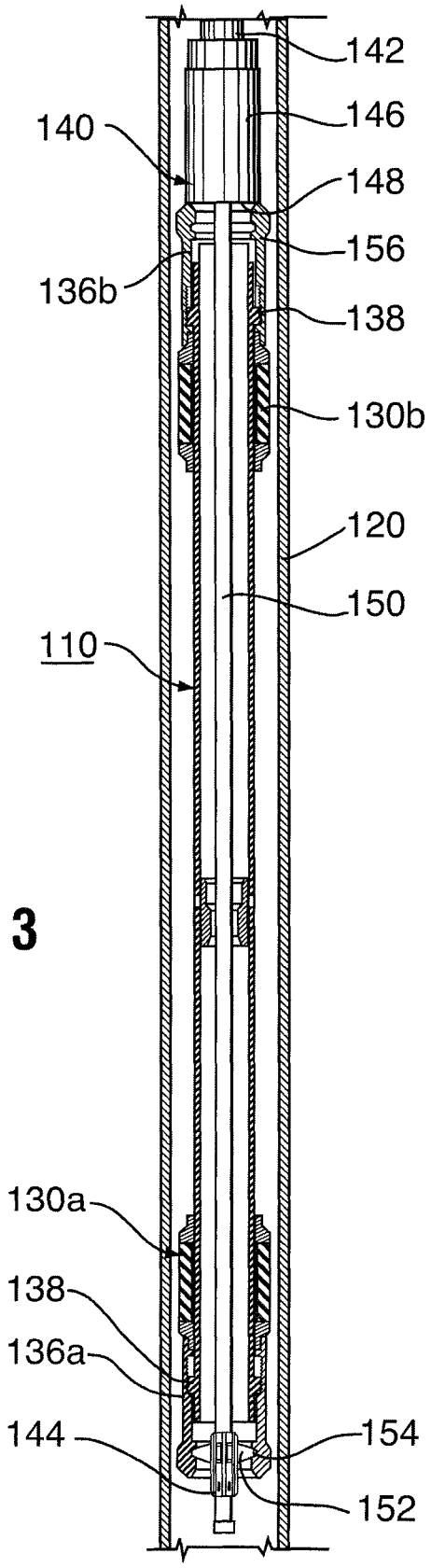
FIG. 3 is an axial sectional view of a tool being conveyed downhole on a setting tool.

It will be appreciated that various modifications can be made to all the components of the illustrated embodiments. For example, the setting sleeves may take various forms. In the illustrated embodiment, for example, the setting sleeve actually forms a part of the tubular body and in particular, ends 112*d* and 112*e* and another portion of the tubular body acts as mandrel over which the setting sleeves ride and become locked. It will be appreciated, that the setting sleeves could alternately be recessed from ends, etc. In addition, or alternately, setting sleeve may be driven in various ways, as by hydraulic force acting against a piston on the sleeve, by a setting tool that drives the sleeves to compress the seals, etc. In one embodiment, for example, the tool may be installed downhole by providing a mechanism that is actuated by compressing the ends of the tool. For example, the ends of the tool may be formed by setting sleeves that can be driven towards each other, advanced along a portion of the tubular body, to install the tool in the well and/or to set the packers. As shown in FIG. 3, a setting tool and installation assembly may be employed that operates by compressing the ends of the tool to secure and seal it in the well. FIG. 3 shows the tool 110 being conveyed through a liner 120 by a hydraulic setting tool 140 on a rod string 142 manipulated from surface. Setting tool 140 includes a collapsible collet 144, an upper hydraulic drive head 146, a base 148 and a connector rod 150 connecting the collet 144 to the drive head. Rod 150 may be driven hydraulically by drive head 146 to move collet 144 toward and away from base 148. Collapsible collet 144 includes dogs 152 engageable in a recess 154 on the lower sleeve 136*a* and base 148 includes a surface having a diameter larger than inner diameter at the end of sleeve 136*b* such that the base cannot pass into the inner diameter. In the run in position, setting sleeves 136*a*, 136*b* are unset, retracted from a compression position against their sealing elements 130*a*, 130*b*. Collapsible collet 144 is locked into engagement with the lower setting sleeve 136*a*, with dogs 152 engaged in a recess 154 on the sleeve. Rod 150 is extended such that base 148 is positioned above or loosely against upper setting sleeve 136*b*. As the assembly of tool 110 and setting tool 140 is run into the well, rod 150 provides stationary positioning of all components. Once the apparatus is at the appropriate depth, pressure is applied to the tubing or work string 142, and the hydraulic setting tool will apply force to drive rod 150 to bring collet 144 upwardly toward base 148. This action drives sleeves 136*a*, 136*b* towards each other compressing the sleeves against their respective elements 130*a*, 130*b*. The force will compress the sealing elements, causing them to extrude outwardly. This creates a seal between tool 110 and liner 120 at both ends of the tool and the force of the extruded packers holds the tool in place in the liner. As the setting sleeves move, ratcheting devices 138 will load up and lock in the relative movement between the setting sleeve and the mandrel of the tool. Once a desired amount of force has been placed into the sealing element, the running tool is released by retracting the collet device 144 to release engagement with the lower end of the tool. Thereafter, the setting rod 150 and collet 144 can be withdrawn from the tool inner diameter 112*b* and the setting tool 140 can be pulled from the well.

Of course, the above described setting tool can alternately be selected to drive the base 148 towards the collet 144, if desired. Alternately or in addition, the setting tool may be selected to operate seals/packers and slips or other installation and sealing mechanisms. It could be conveyed and manipulated by wireline, pipe or coiled tubing, could include operational and components of a long stroke setting tool, include various setups with inner and outer mandrels different than those specifically disclosed or be driven by explosive, hydraulic or electrical motors to squeeze and set.

In another embodiment, the installation assembly may be reversed out of a condition engaging the tool to the liner such that the tool can be removed from its position over the perforated interval and possibly from the well. In some embodiments, therefore, tool 120 may include a release mechanism that allows the installation assembly to be released. For example, in the illustrated embodiment, sleeve 136*b* includes a fishing neck form 156 for engagement by a grapple pulling tool that can overcome the lock of ratchet devices 138 to release at least the upper element 13011 Other options may include an overshot to grab and release lock, a collet type release, top release and/or latch threads on top end.

It is to be noted that the tool of FIG. 1 can also be used to form a wellbore installation. In such an installation, however, there being no ports, the tool of FIG. 1 acts as an unopenable patch. The perforations could then only be reopened by removing the tool from over the perforations.

Figure 4A:
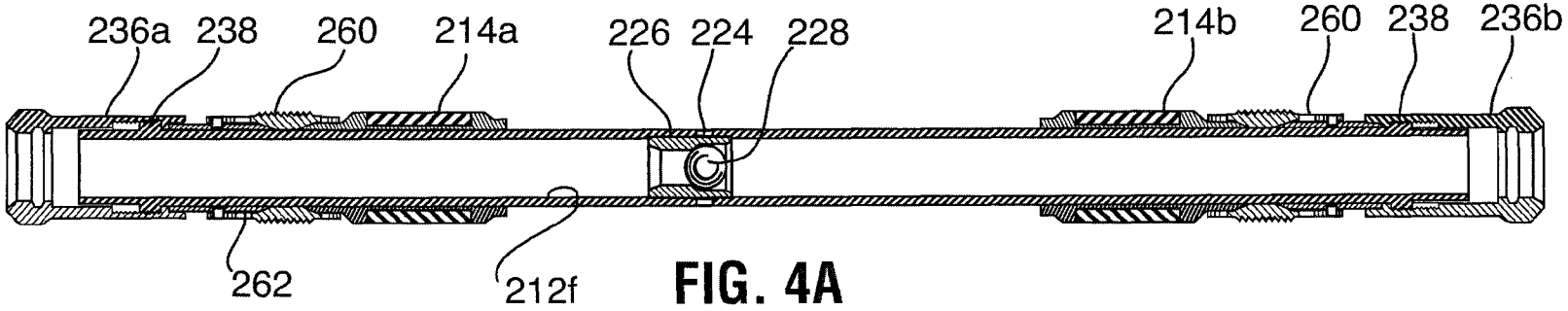
FIG. 4A and 4B are sequential axial sectional views of another wellbore tool useful to allow mechanical isolation of a perforated segment in a well.
Figure 4B:
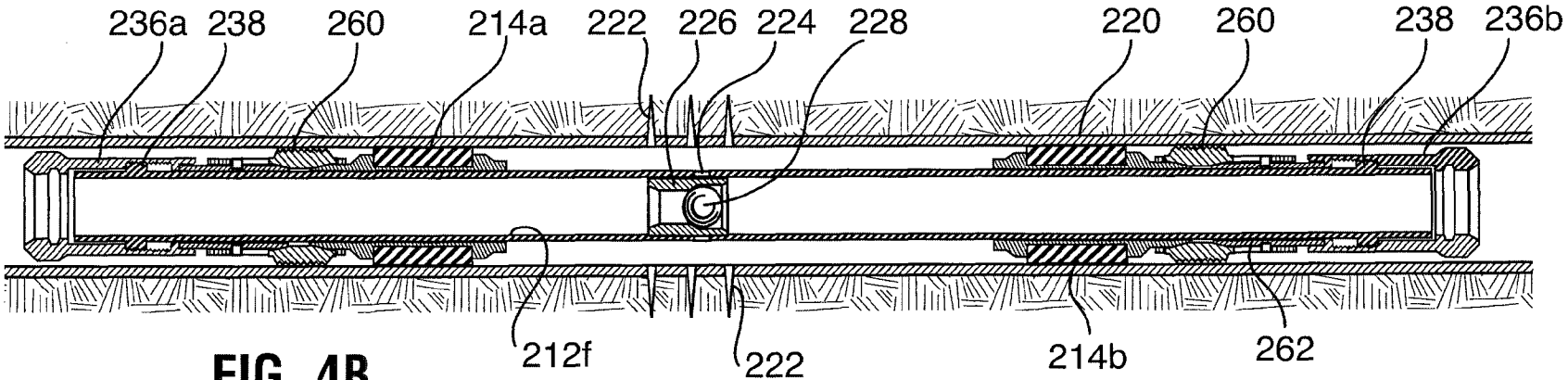

Another tool according to the present invention is shown in FIG. 4. This tool has an installation assembly including slips 260 in addition to the packers 214*a*, 214*b*. This embodiment provides extra anchoring between the casing 220 and the apparatus so the forces created during pumping or any other well operations do not cause the tool to slide or move in relation to its position across the perforations 222. This embodiment may be set in various ways, including for example, by use of setting sleeves 236*a*, 236*b* and a ratcheting devices 238 that are movable relative to a mandrel portion 212*f* of the tubular body. As the setting sleeves move, they push a sloped cone 262 beneath the slips 260, which forces the slips out until they contact, bite into and grip the casing. The sleeves 236*a*, 236*b* will then continue to move and will load into the packing elements 214*a*, 214*b* and cause them to extrude out against casing 220 until seals are formed at both ends of the tool between the casing and the tool. Once fully set, the slips will anchor the tool to the casing. The sealing elements assist in anchoring the tool in the wellbore but primarily seal against fluid flow to the perforations. Although a tool including slips could include a non-ported body, the tool of FIG. 3 includes a plurality of ports 224 closed by a sliding sleeve mechanism 226, such that if fluid communication to the perforations is of interest, such communication can be achieved by opening the ports. In particular, in this illustrated embodiment, when desired, a ball 228 or plug can be pumped into the well to seat on the ID restriction in the sleeve. The pressure behind the ball will move the sleeve down to open the ports 224 and allow diversion of fluid out the port between the elements.

In another embodiment, the tool may incorporate setting chambers that can be activated using hydraulic or hydrostatic pressure to compress and extrude the slips and/or the packing element. These cylinders can be incorporated into the tool, either on one end or on both ends. The pressure chambers may be activated with tubing pressure or by mechanical means. As the packer is set, the force of setting may be locked in place using an internal locking device or device(s) such as slips.

The tool of the present invention can be further modified as desired. For example, tools are contemplated that include options as set out above and one or more of (i) slips, if any, including one or more of RSB style slips and Rockseal style slips, available from Packers Plus Energy Services, Inc., Calgary, Canada; a lock system including one or more of a ratchet system, standard mandrel lock, a collet for releasing at the top of the tool, for example for upper packer; and (ii) port flow control including one or more of the following: shift sleeve with wireline or by dropping a ball, electric/hydraulic options for opening ports, sensors positioned in the tool that opens a port closure when remotely actuated to do so.

Such a tool is intended for downhole operations and thus must be constructed to withstand downhole conditions for at least a short period of time. The tool length is selected to be long enough to adequately cover and seal a perforated interval with the ends of the tubular body being adjacent but slightly above and below the interval, but not be so long that the inconvenience, time, weight and complex equipment requirement associated with running a string of more than 2 or 3 tubular joints is avoided. It is believed that the most usual dimensions are as follows: length max between seals 30 feet and max from end to end of tubular body 36 feet. Of course, the tool's dimensions are dependent on the size of the wellbore to be serviced and the material limitations.

Once the tool is in place, and the sealing elements are extruded, the apparatus will isolate perforations in the casing string and fluid can pass through the apparatus to a deeper point in the well. Once the device is in place, the combination of sealing elements, tubular body and ports and their closures, if any, will allow selective fluid placement.

The tool may be used in a wellbore fluid treatment process. In such a process, a tool such as in any one of the various embodiments disclosed hereinbefore, may be provided, run into the hole and installed over a perforated interval. The tool can be positioned such that it tubular body overlaps with the perforated interval and, in particular, the upper seal is positioned just above the perforated interval and the lower seal is positioned just below the perforated interval. The ends of the tubular are likewise positioned. Thereafter the seals and any further installation mechanism are set to secure the tubular body in the wellbore and to create a seal between the tubular body and the wellbore wall above and below the perforated interval.

The tool can also provide a method to enter an existing well that has perforations that may be producing or may be already depleted. The tool may be run with or without an openable sleeve. The tool may be placed across an interval that will not require fluid placement, thus allowing diversion to areas that will. This will allow fluid treatment of new intervals that may be among or between existing producing or injection intervals. It may be possible to treat or stimulate several new sections without permanently abandoning existing intervals. These existing intervals can them be opened to produce or left isolated.

A tool can be provided for a plurality, and possibly all, of the perforated intervals in a well. When selecting the number of tools required consideration may be given to the nature of the tool and the portion of the well to be treated. Since a tool, in one embodiment, can be plugged to close off a lower portion of a well from the upper portion thereof, only perforations above the lowest perforation of interest need be closed off with a patch tool, if desired. Alternately, if all the perforated intervals in a well are to be treated, all the perforated intervals except at least one can have installed thereover a patch tool. Alternately, if it is desired to isolate all perforated intervals from all other perforated intervals or one or more selected intervals from all other intervals, tools can be installed over all or the selected intervals. The at least one interval left without a tool installed thereover may be the interval(s) treated first, while all of the ports of the other tools remain closed. The at least one interval left without a tool installed thereover may be the lower most interval in the well or any other interval.

After treatment of any open intervals, the ports of the other intervals may be opened all together or in turn when selected to allow fluid treatment therethrough.

The tool is selected to act as a patch over the perforated interval, but if desired to allow controlled fluid access to the perforated interval therethrough. The tool may be installed after the wellbore liner is placed and perforated. In fact, the tool allows many and possibly all perforations to be made at once before wellbore fluid treatment commences, which may facilitate operations by allowing similar processes along the length of the string to reduce costs and time and material requirements.

If closures are provided that can be opened and closed, any perforated intervals can be treated in sequence. However, reclosure of any ports opened can be avoided by treating perforations sequentially toward surface and plugging the liner below each interval being treated.

Plugging may be achieved by various means such as one or more bridge plugs installed below the interval, which later may be removed to allow production therethrough. Alternately, plugs such as balls may be launched from surface to seat in a portion of the tool, or in another tool immediately below the tool, through which a treatment is being effected. In one embodiment, using a sleeve-type closure opened by a ball seated therein, the ball and seat may create a plug below the ports of that tool. If it is desirable to treat the section that is isolated by the apparatus, then a ball or plug can be pumped into the well, and will seat on a restricted internal diameter that straddles the port. As the ball lands in the seat, it will prevent fluid from moving past the seat and it will create pressure above. The pressure will move the seat to an open position, and fluid will be diverted out of the port. The fluid will be forced out the port but will be contained by the sealing elements, thereby producing mechanical diversion of fluids into the segment isolated by the perforations.

In another embodiment a wireline conveyed plug may be used, which can be repeatedly positioned, expanded to a plugging position, retracted and moved to a new location (or removed from the well).

After the wellbore treatment is completed, the patch tools may be left in place in the well and possibly used to control flow through the well or the tools may be removed.

Figure 5:
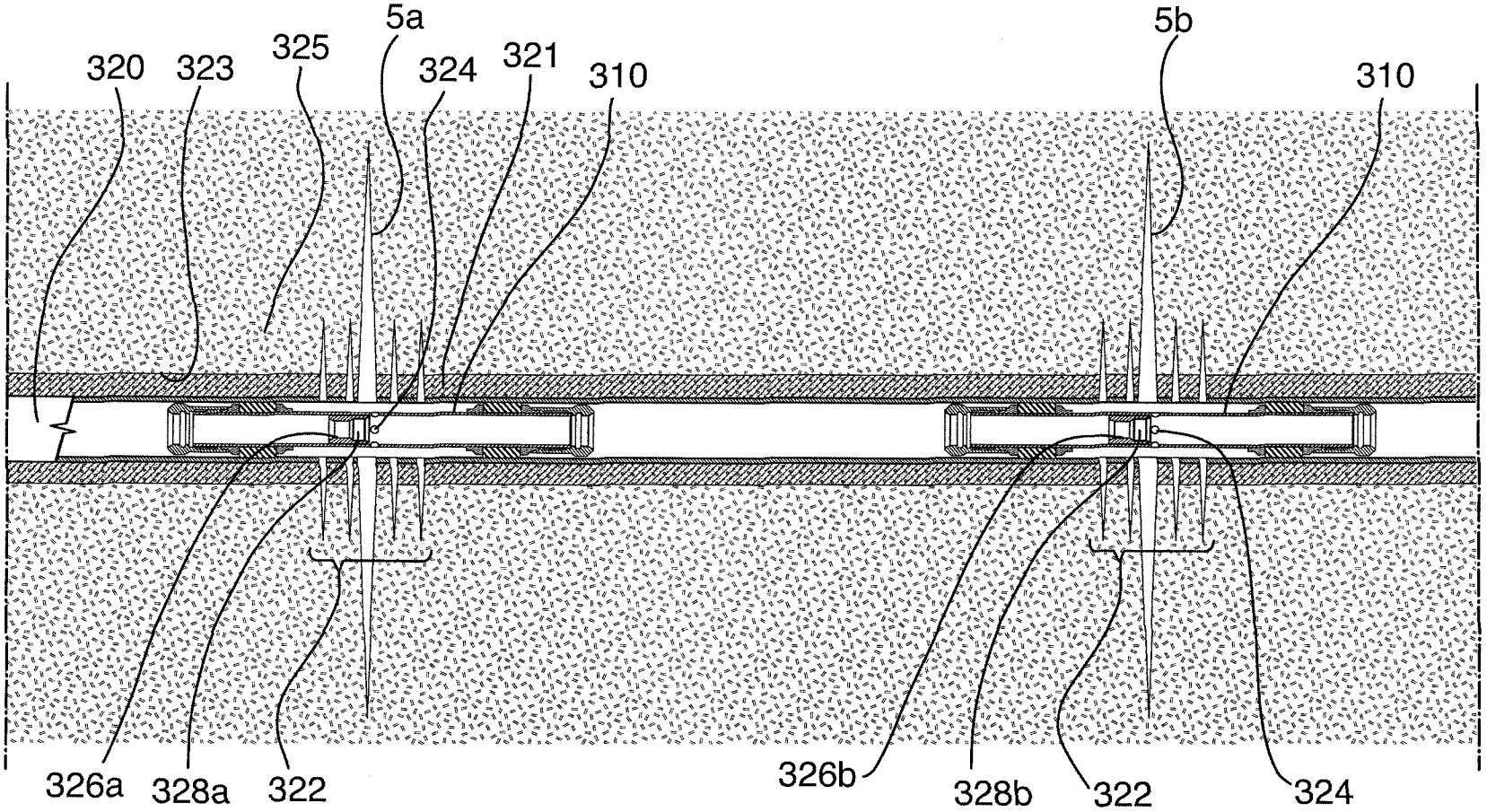
FIG. 5 is a sectional view along a length of a wellbore having tools installed therein.

For example, with reference to FIGS. 5, multiple tools 310 may be deployed in a single well across various perforated intervals 322. The well may include casing 320, cement 321 between the casing and the borehole wall 323 of the formation rock 325. Once these tools are installed, with ports 324 closed all fluid will be diverted to a lower point in the well. The tools can be selectively activated to open any ports in the tools by any one of the various options noted above. In the illustrated embodiment, variously sized balls or plugs 328 can be employed to open various sleeves 326 and thereby intervals and to individually place fluid in these intervals. When operations such as acidizing or hydraulic fracturing are required to make a well more productive, then these apparatus will provide the ability to perform pumping g operations in desired sections of the well, thus producing only one fracture at a time. In the illustrated embodiment, sleeve 326*a* is opened first by launching plug 328*a* to fracture 5*a* that interval. Thereafter, sleeve 326*b* is opened by launching plug 328*b*, allowing fracture 5*b* to be generated.

Once the operations are completed, all or some intervals may be opened or closed selectively to obtain desired production results. In addition, it may be possible to control inflow using a flow regulating device such as a choke or tortuous path. This will allow the distribution of production across all intervals or selectively preferred so that some intervals will be allowed to produce more than others. This may be used to place a higher drawdown to the toe of the well, for example, so that depletion may take place evenly.

In another embodiment, a flow regulating device may be used for injection to systematically distribute injection fluids to desirable sections of the well.

In another application, the tools can be used at any time during the producing life of the well to close segments within the well. The may be accomplished by shifting the ball activated port system to the closed position. The sleeve may be shifted using a shifting tool that will temporarily lock into the sleeve and allow an upward force required to move it to the closed position. For example, the tool may provide an application of shutting off unwanted water that may encroach on a producing well. It may be desirable to close this section of the well in downhole for both economic and environmental reasons.

The documents referenced herein are incorporated herein by reference in their entirety.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A wellbore treatment tool comprising: a tubular body including a first open end, a second open end and a wall extending from the first open end to the second open end, the wall defining an outer surface and an inner diameter, with the first open end and the second open end providing access to the inner diameter; a port through the wall; a sliding sleeve valve acting as a closure for the port, the sliding sleeve actuable between a closed position closing the port and an open position wherein the port is open and the sliding sleeve valve including a seat exposed to catch and seal with a separate plug, the sliding sleeve valve being actuable from the closed position to the open position by creating a pressure differential across the seat when the plug is caught; a sealing element to isolate a mid region of the outer surface from the first open end and the second open end; and a setting mechanism for the sealing element operable to set the sealing element by compressing the first open end and the second open end toward each other, wherein the wall is no more than 12 meters long from the first open end to the second open end.

2. The wellbore treatment tool of claim 1 wherein the sealing element includes an upper annular seal and a lower annular seal and the upper annular seal and the lower annular seal are spaced apart by no more than 10 meters.

3. The wellbore treatment tool of claim 1 further comprising a set of slips between the first open end and the port and a set of slips between the second open end and the port.

4. A method for fluid treating a formation accessed by a well, the well including a casing liner having an inner wall with a perforated interval, the method comprising: installing a tool over the perforated interval, the tool including tubular body including a first open end, a second open end and a wall extending from the first open end to the second open end, the wall defining an outer surface and an inner diameter, with the first open end and the second open end providing access to the inner diameter; a port through the wall; a sliding sleeve valve acting as a closure for the port, the sliding sleeve actuable between a closed position closing the port and an open position wherein the port is open and the sliding sleeve valve including a seat exposed to catch and seal with a separate plug, the sliding sleeve valve being actuable from the closed position to the open position by creating a pressure differential across the seat when the plug is caught; and a sealing element to isolate a mid region of the outer surface from the first open end and the second open end, the tool positioned in the well with the first open end within 5 meters of an uppermost perforation of the perforated interval and the second open end within 5 meters of a lowermost perforation of the perforated interval and with the sealing element forming a seal between the tubular body and the casing inner wall above and below the perforated interval to isolate fluid flow from passing around the first and second open ends, along the outer surface to the perforated interval, wherein installing includes compressing the first open end and the second open end toward each other to form the seal; and treating the formation accessed by the well by landing the plug on the seat to move the sliding sleeve to the open position and moving wellbore treatment fluid through the port and the perforated interval to the formation.

5. The method of claim 4 wherein installing further includes setting slips adjacent the first open end and the second open end to grip the casing inner wall.

6. The method of claim 4 wherein treating includes launching the plug from surface to pass through the well and land in the seat.

7. The method of claim 4 further comprising plugging the well below the port to divert the wellbore treatment fluid to the port.

8. The method of claim 7 wherein landing the plug on the seat plugs the well.

9. A method for fluid treating a formation accessed by a well, the well including a casing liner having an inner wall with a lower perforated interval and an upper perforated interval spaced uphole of the lower perforated interval, the method comprising: while the lower perforated interval remains exposed in the well, installing a tool over the upper perforated interval, the tool including a tubular body including an inner diameter and an outer surface, a first open end and a second open end, the first and second open ends providing access to the inner diameter; and a sealing element to isolate a mid region of the outer surface from the first open end and the second open end, the tool positioned in the well with the first open end adjacent and above the upper perforated interval and the second open end uphole of the lower perforated interval and adjacent and below the upper perforated interval and with the sealing element forming a seal between the tubular body and the casing inner wall above and below the upper perforated interval to isolate fluid flow from passing around the first and second open ends, along the outer surface to the upper perforated interval, wherein installing includes compressing the first open end and the second open end toward each other to form the seal;

moving wellbore treatment fluid through the well and through the tool to the lower perforated interval; and treating the formation accessed by the well by moving the wellbore treatment fluid through the lower perforated interval to the formation.

10. The method of claim 9 wherein installing further includes positioning the first open end within 5 meters of an uppermost perforation of the upper perforated interval and the second open end within 5 meters of a lowermost perforation of the upper perforated interval.

11. The method of claim 9 wherein installing further includes setting slips adjacent the first open end and the second open end to grip the casing inner wall.

12. The method of claim 9 further comprising introducing fluid through a port in the tubular body to treat the formation through the upper perforated interval.

13. The method of claim 12 further comprising launching a plug from surface to pass through the well and open a closure covering the port.

14. The method of claim 12 further comprising plugging the well below the port and above the lower perforated interval.

15. The method of claim 14 wherein plugging includes launching a plug from surface to pass through the well and form a plug below the port and above the lower perforated interval.

16. A wellbore treatment tool comprising: a tubular body including a first open end, a second open end and a wall extending from the first open end to the second open end, the wall defining an outer surface and an inner diameter, with the first open end and the second open end providing access to the inner diameter; a port through the wall; a sliding sleeve valve acting as a closure for the port, the sliding sleeve actuable between a closed position closing the port and an open position wherein the port is open and the sliding sleeve valve including a seat exposed to catch and seal with a separate plug, the sliding sleeve valve being actuable from the closed position to the open position by creating a pressure differential across the seat when the plug is caught; a set of slips between the first open end and the port and a set of slips between the second open end and the port; and a sealing element to isolate a mid region of the outer surface from the first open end and the second open end, wherein the wall is no more than 12 meters long from the first open end to the second open end.

17. The wellbore treatment tool of claim 16 wherein the sealing element includes an upper annular seal and a lower annular seal and the upper annular seal and the lower annular seal are spaced apart by no more than 10 meters.

18. A method for fluid treating a formation accessed by a well, the well including a casing liner having an inner wall with a perforated interval, the method comprising:

installing a tool over the perforated interval, the tool including tubular body including a first open end, a second open end and a wall extending from the first open end to the second open end, the wall defining an outer surface and an inner diameter, with the first open end and the second open end providing access to the inner diameter; a port through the wall; a sliding sleeve valve acting as a closure for the port, the sliding sleeve actuable between a closed position closing the port and an open position wherein the port is open and the sliding sleeve valve including a seat exposed to catch and seal with a separate plug, the sliding sleeve valve being actuable from the closed position to the open position by creating a pressure differential across the seat when the plug is caught; and a sealing element to isolate a mid region of the outer surface from the first open end and the second open end, the tool positioned in the well with the first open end within 5 meters of an uppermost perforation of the perforated interval and the second open end within 5 meters of a lowermost perforation of the perforated interval and with the sealing element forming a seal between the tubular body and the casing inner wall above and below the perforated interval to isolate fluid flow from passing around the first and second open ends, along the outer surface to the perforated interval, wherein installing includes setting slips adjacent the first open end and the second open end to grip the casing inner wall; and treating the formation accessed by the well by landing the plug on the seat to move the sliding sleeve to the open position and moving wellbore treatment fluid through the port and the perforated interval to the formation.

19. The method of claim 18 wherein treating includes launching the plug from surface to pass through the well and land in the seat.

20. The method of claim 18 further comprising plugging the well below the port to divert the wellbore treatment fluid to the port.

21. The method of claim 20 wherein landing the plug on the seat plugs the well.

22. A method for fluid treating a formation accessed by a well, the well including a casing liner having an inner wall with a lower perforated interval and an upper perforated interval spaced uphole of the lower perforated interval, the method comprising: while the lower perforated interval remains exposed in the well, installing a tool over the upper perforated interval, the tool including a tubular body including an inner diameter and an outer surface, a first open end and a second open end, the first and second open ends providing access to the inner diameter; and a sealing element to isolate a mid region of the outer surface from the first open end and the second open end, the tool positioned in the well with the first open end adjacent and above the upper perforated interval and the second open end uphole of the lower perforated interval and adjacent and below the upper perforated interval and with the sealing element forming a seal between the tubular body and the casing inner wall above and below the upper perforated interval to isolate fluid flow from passing around the first and second open ends, along the outer surface to the upper perforated interval, wherein installing includes setting slips adjacent the first open end and the second open end to grip the casing inner wall;

moving wellbore treatment fluid through the well and through the tool to the lower perforated interval; and treating the formation accessed by the well by moving the wellbore treatment fluid through the lower perforated interval to the formation.

23. The method of claim 22 wherein installing further includes positioning the first open end within 5 meters of an uppermost perforation of the upper perforated interval and the second open end within 5 meters of a lowermost perforation of the upper perforated interval.

24. The method of claim 22 further comprising introducing fluid through a port in the tubular body to treat the formation through the upper perforated interval.

25. The method of claim 24 further comprising launching a plug from surface to pass through the well and open a closure covering the port.

26. The method of claim 24 further comprising plugging the well below the port and above the lower perforated interval.

27. The method of claim 26 wherein plugging includes launching a plug from surface to pass through the well and form a plug below the port and above the lower perforated interval.

* * * * *